US010914093B2

(12) United States Patent
Hejazi et al.

(10) Patent No.: US 10,914,093 B2
(45) Date of Patent: Feb. 9, 2021

(54) VOLUMETRIC COMPRESSION RESTRAINER

(71) Applicant: Universiti Putra Malaysia, Serdang (MY)

(72) Inventors: Farzad Hejazi, Selangor (MY); Mohd Saleh Jaafar, Selangor (MY)

(73) Assignee: Universiti Putra Malaysia, Selangor (MY)

( * ) Notice: Subject to any disclaimer, the term of this patent is extended or adjusted under 35 U.S.C. 154(b) by 0 days.

(21) Appl. No.: 16/433,332

(22) Filed: Jun. 6, 2019

(65) Prior Publication Data

US 2019/0376281 A1 Dec. 12, 2019

(30) Foreign Application Priority Data

Jun. 6, 2018 (MY) ..... PI 2018702230

(51) Int. Cl.
*E04H 9/02* (2006.01)

(52) U.S. Cl.
CPC ..... *E04H 9/0215* (2020.05)

(58) Field of Classification Search
CPC ..... F16F 2236/045; F16F 3/0876; F16F 7/09; F16F 1/445; F16F 9/303; F16F 1/40; F16F 3/0873; F16F 7/125; E04H 9/02; E04H 9/0215
USPC ..... 267/293, 294, 153
See application file for complete search history.

(56) References Cited

U.S. PATENT DOCUMENTS 2,497,829 A * 2/1950 Baselt ..... F16F 7/09 267/209
RE24,654 E * 6/1959 sheets ..... F16F 1/406 267/35
3,904,226 A * 9/1975 Smalley ..... B60D 1/50 280/486
4,475,722 A * 10/1984 Paton ..... B60G 15/04 267/202
5,230,407 A * 7/1993 Smith ..... B64C 27/001 188/281
6,158,374 A * 12/2000 Free, Jr. ..... B63B 21/00 114/215

(Continued)

*Primary Examiner* — Brian E Glessner
*Assistant Examiner* — Daniel J Kenny
(74) *Attorney, Agent, or Firm* — Cesari & McKenna, LLP

(57) ABSTRACT

The present invention relates to a volumetric compression restrainer (100), characterised by: an outer casing (101) comprising a pair of C-shaped structures interconnected to one another to form a cylinder; a plurality of partitions (102) arranged in a parallel manner along length of an inner surface of the pair of C-shaped structures with a spacing therebetween; an inner core (103) extending through the outer casing (101), whereby the plurality of partitions (102) enclosed the inner core (103); a plurality of hollow plates (104) mounted on the inner core (103), for spacing and upholding the inner core (103); a plurality of damping means (105) wrapped over the inner core (103), arranged in a manner of the plurality of damping means (105) positioned between the plurality of partitions (102) and the plurality of hollow plates (104); and a connecting means having a front connector (106) engaged to one end of the inner core (103) and an end connector (107) engaged to the other end of the inner core (103), for installing the volumetric compression restrainer (100) to a structure joint.

4 Claims, 8 Drawing Sheets

(56) References Cited

U.S. PATENT DOCUMENTS

| | | | | |
|---|---|---|---|---|
| 6,443,437 | B1 * | 9/2002 | Beyene | B60G 11/22 267/141.1 |
| 8,360,140 | B2 * | 1/2013 | Zabelka | E21B 43/121 166/70 |
| 9,441,696 | B2 * | 9/2016 | McCurter | B60D 1/50 |

* cited by examiner

VOLUMETRIC COMPRESSION RESTRAINER

CROSS REFERENCE TO RELATED APPLICATION

This application claims priority to Malaysian Application No. PI 2018702230, filed on Jun. 6, 2018. The contents of which are hereby incorporated by reference in their entirety.

BACKGROUND OF THE INVENTION

Field of the Invention

This invention relates to a restrainer, more particularly relates to a volumetric compression restrainer for controlling and preventing the excessive displacement of structures by providing incremental stiffness during earthquake excitation, wind or any vibrations.

Description of Related Arts

Earthquake is a sudden and rapid shaking of the ground. Said earthquake has damaging effects on life, homes, property, environment and et cetera. Therefore, earthquake resistant construction such as bridge is significantly important. Bridges with multiple spans are often constructed with joints to accommodate temperature-dependent and time-dependent deformations. During seismic events, poundings between the adjacent bridge components can occur when the relative closing displacement is larger than the expansion gap size. Pounding of adjacent bridge segments may cause damage to surround impact locations and also increase the relative opening movement between adjacent components of a bridge structure.

On the other hand, unseating failure occurs when the relative opening displacement is larger than the provided seat width. The damages related to pounding and unseating have been observed in many recent major earthquakes, e.g. the 2011 Christchurch earthquake (Chouw & Hao, 2012), 2010 Chile earthquake (Kawashima, Unjoh, Hoshikuma, & Kosa, 2011), 2008 Wenchuan earthquake (Lin, Hung, Liu, & Chai, 2008), 2006 Yogyakarta earthquake (Elnashai, Kim, Yun, & Sidarta, 2007), 1999 Chi-Chi earthquake (Earthquake Engineering Research Institute, 1999), 1995 Kobe earthquake (Kawashima & Unjoh, 1996) and 1994 Northridge earthquake (Hall, 1994). Therefore, there is a need to have appropriate devices to prevent unseating of the bridge spans.

Spans could be tied together with a restrainer which made of steel cables or steel rods. Said traditional restrainers have many limitations such as small elastic strain range and limited ductility capacity. Therefore, a significant number of researches were carried out to address the limitation of the restrainers such as use various types of new materials or use of dissipating device as restrainers. These new restrainers may be alleviated the limitation of the traditional restrainer but have involved high cost of materials, less durability, sensitive to earthquake ground motion characteristics and sensitive to ambient temperature. Thus, an improve device for overcoming said limitation is significantly important.

China Patent Application No. 102221061B has disclosed a shock absorber damping rubber spring comprising a high damping rubber and a cylindrical helical compression spring which is vulcanized together with a cylindrical helical compression spring, a lower base and an upper base. The high damping rubber has a cylindrical shape, a through hole is provided on the lower base and the upper base, and a high damping rubber is arranged around the through hole. Said shock absorber provides the elastic recovery force and damping force which is necessary for the shock absorption. However, the shock absorber which functioning only for damping of displacement through shear action of high damping rubber may cause excessive displacement due to strong earthquakes, wind or vibrations.

United States Patent Application No. 20130174501 A1 has disclosed a compressed elastomer damper for earthquake hazard reduction. A passive damper for earthquake hazard reduction includes an inner member received in an outer member, with an elastomeric material disposed in the gaps between the inner and outer member. The elastomeric material has at least a first and a second portion. The first portion is bonded or connected to both the inner member and outer member such that no slippage occurs between the members and the material. The second portion is not bonded or connected to at least one of the inner and outer members such that slippage may occur. This leads to friction-like damping under large strains. However, said elastomer damper with the elastomeric material in between the steel members may not be able to withstand strong vibration and movement. This is because the configuration of the attachment elastomeric material in the damper may not have sufficient support to hold the vibration and movement of a structure.

U.S. Pat. No. 6,701,680 B2 has disclosed an energy absorbing seismic brace for both retrofit and new construction. The brace comprises a central strut of either multi-legged or homogeneous section fabricated from low strength aluminium, whose characteristics maximize the seismic energy absorption for a building installation. Said central strut absorbs energy at high weight-specific levels by virtue of the hysteresis in its load-deflection relationship. In order to eliminate the possibility of buckling of the energy absorbing strut when it passes through the compression portion of a load cycle, it is surrounded by a system of spacers and an external sleeve providing very high bending rigidity at low weight. The spacers may be fabricated from low-density foams, pseudo-concrete, fibrous composites, or metals, depending upon the application. The outer sleeve may also be fabricated from a variety of materials, depending upon whether the embodiment calls for the principal bending rigidity to be provided by the spacers or sleeve. However, said friction seismic brace may have the disadvantage of deterioration when the friction surfaces deteriorate with the repeated use and time.

None of the prior arts presents the features as in the teaching of the present invention. Accordingly, it can be seen in the prior arts that there is a need to provide a volumetric compression restrainer for controlling and preventing the excessive displacement of structures by providing incremental stiffness during earthquake excitation, wind or any vibrations.

SUMMARY OF INVENTION

It is an objective of the present invention to provide a restrainer with high stiffness for preventing excessive displacement which cause damage to the structure or pounding and unseating for bridge span.

It is also an objective of the present invention to provide a restrainer with compression volumetric condition to generate adequate resistance force for the structure.

It is yet an objective of the present invention to provide a volumetric compression restrainer to protect the structure against displacement beyond allowable movements.

Accordingly, these objectives may be achieved by following the teachings of the present invention. The present invention relates to volumetric compression restrainer, characterised by: an outer casing (101) comprising a pair of C-shaped structures interconnected to one another to form a cylinder; a plurality of partitions (102) arranged in a parallel manner along length of an inner surface of the pair of C-shaped structures with a spacing therebetween; an inner core (103) extending through the outer casing (101), whereby the plurality of partitions (102) enclosed the inner core (103); a plurality of hollow plates (104) mounted on the inner core (103), for spacing and upholding the inner core (103); a plurality of damping means (105) wrapped over the inner core (103), arranged in a manner of the plurality of damping means (105) positioned between the plurality of partitions (102) and the plurality of hollow plates (104); and a connecting means having a front connector (106) engaged to one end of the inner core (103) and an end connector (107) engaged to the other end of the inner core (103), for installing the volumetric compression restrainer (100) to a structure joint.

BRIEF DESCRIPTION OF THE DRAWINGS

The features of the invention will be more readily understood and appreciated from the following detailed description when read in conjunction with the accompanying drawings of the preferred embodiment of the present invention, in which.

DETAILED DESCRIPTION OF THE INVENTION

Figure 1:
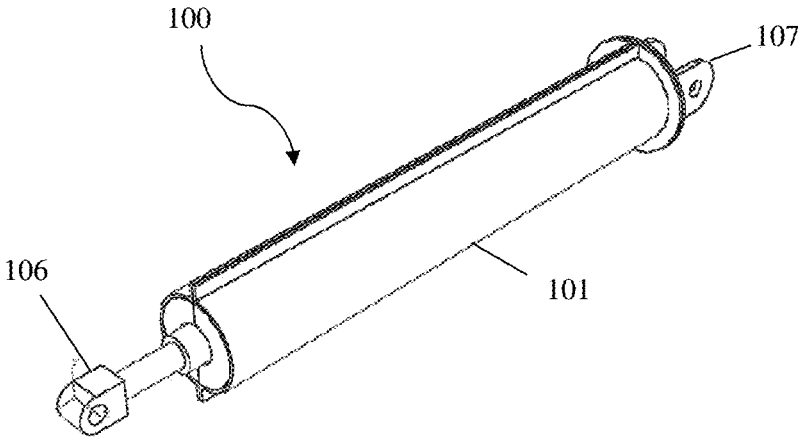
FIG. 1 shows a volumetric compression restrainer.
Figure 2:
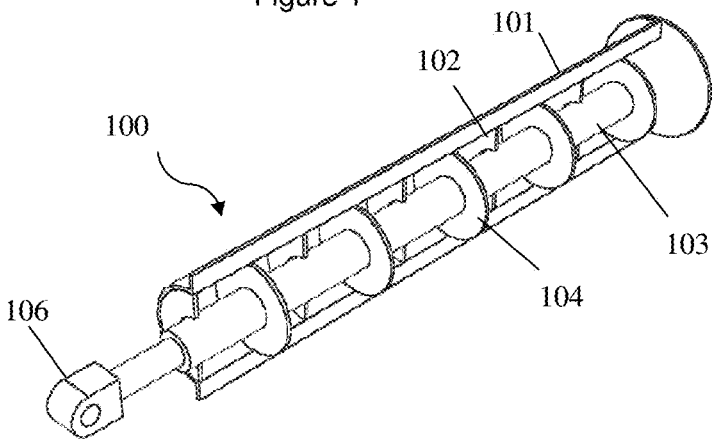
FIG. 2 shows an inner perspective view of the volumetric compression restrainer in FIG. 1.
Figure 3:
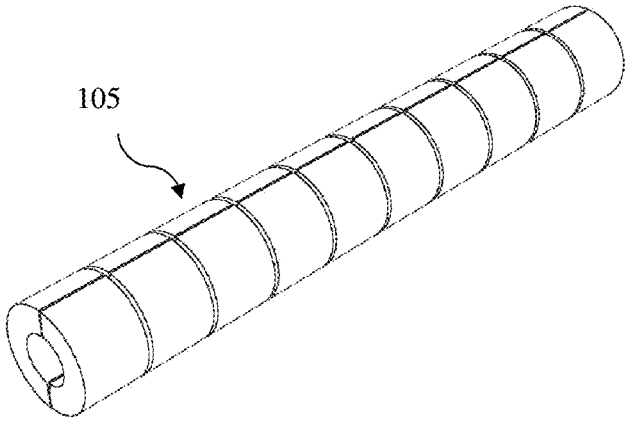
FIG. 3 shows a damping means that is fixed inside the volumetric compression restrainer in FIG. 1.
Figure 4:
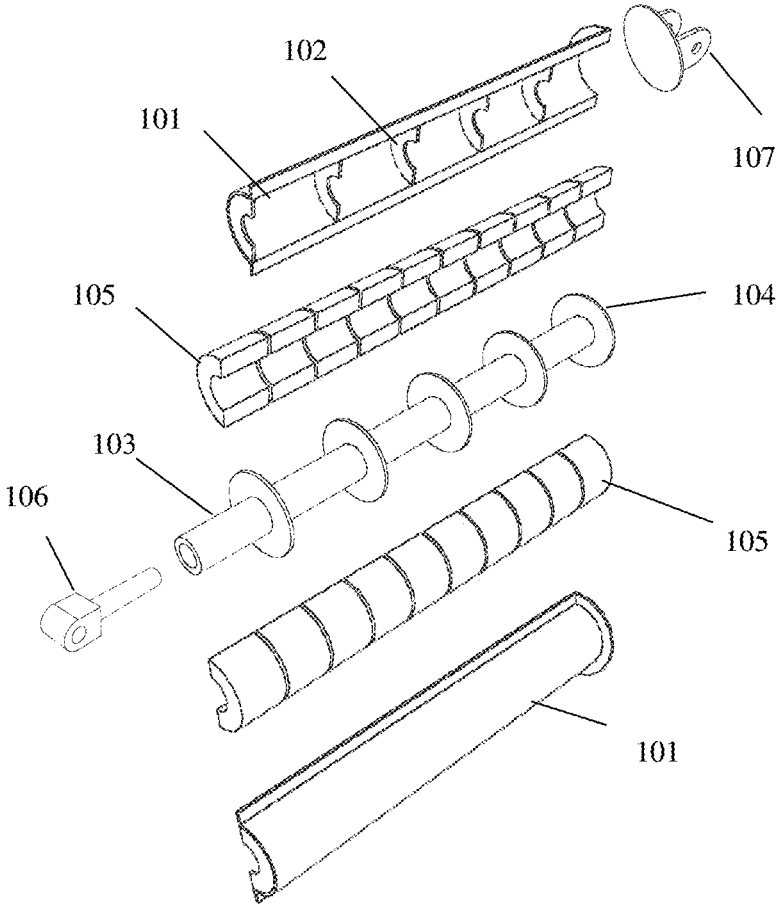
FIG. 4 shows an exploded view of the volumetric compression restrainer in FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting but merely as a basis for claims. It should be understood that the drawings and detailed description thereto are not intended to limit the invention to the particular form disclosed, but on the contrary, the invention is to cover all modifications, equivalents and alternatives falling within the scope of the present invention as defined by the appended claims. As used throughout this application, the word "may" is used in a permissive sense (i.e., meaning having the potential to), rather than the mandatory sense (i.e., meaning must). Similarly, the words "include," "including," and "includes" mean including, but not limited to. Further, the words "a" or "an" mean "at least one" and the word "plurality" means one or more, unless otherwise mentioned. Where the abbreviations or technical terms are used, these indicate the commonly accepted meanings as known in the technical field. The present invention will now be described with reference to FIGS. 1-14.

The present invention presents a volumetric compression restrainer (100), characterised by:

- an outer casing (101) comprising a pair of C-shaped structures interconnected to one another to form a cylinder;
- a plurality of partitions (102) arranged in a parallel manner along length of an inner surface of the pair of C-shaped structure with a spacing therebetween;
- an inner core (103) extending through the outer casing (101), whereby the plurality of partitions (102) enclosed the inner core (103);
- a plurality of hollow plates (104) mounted on the inner core (103), for spacing and upholding the inner core (103);
- a plurality of damping means (105) wrapped over the inner core (103), arranged in a manner of the plurality of damping means (105) positioned between the plurality of partitions (102) and the plurality of hollow plates (104); and
- a connecting means having a front connector (106) engaged to one end of the inner core (103) and an end connector (107) engaged to the other end of the inner core (103), for installing the volumetric compression restrainer (100) to a structure joint.

In a preferred embodiment of the present invention, the pair of C-structures connected to each other by bolts and nuts.

In a preferred embodiment of the present invention, the plurality of damping means (105) is a hyperelastic material. Said hyperelastic material comprises rubber such as isoprene, ethylene propylene diene (EPDM) or polybutadiene.

In one embodiment of the present invention, the front connector (106) and end connector (107) comprises hinges for allowing installation of the volumetric compression restrainer (100) to a structure joints.

In a preferred embodiment, the plurality of hollow plates (104) and the plurality of partitions (102) are positioned in parallel to one another where the plurality of damping means (105) is placed between them. The displacement is transferred to the hyperelastic characteristics of the plurality of damping means (105) through the plurality of hollow plates (104). The plurality of partitions (102) is supporting the plurality of damping means (105) as restrainer.

In a preferred embodiment, the volumetric compression restrainer (100) is not limited to be used for building, vessel, vehicle, bridge, machinery only but can be used for any structures subjected to dynamic loads and vibration.

The volumetric compression restrainer (100) has limited displacement within an allowable range and once displacement is out of the range, said restrainer in present invention is providing high stiffness to prevent of excessive displacements which cause damage to the structure or pounding and unseating for bridge span.

Below is the example of the volumetric compression restrainer (100) for preventing excessive displacement of structures, from which the advantages of the present invention may be more readily understood. It is to be understood that the following examples are for illustrative purpose only and should not be construed to limit the present invention in any way.

EXAMPLE

A volumetric compression restrainer (100) for preventing excessive displacement of structures was developed and shown in FIGS. 1-4. Referring to FIGS. 1-4, the volumetric compression restrainer (100) is developed with an outer casing (101) which comprises a pair of C-shaped structures interconnected to one another to form a cylinder by bolts and nuts. Said pair of C-shaped structures has a plurality of partitions (102) arranged in a parallel manner along length of an inner surface of the pair of C-shaped structures with a spacing therebetween. An inner core (103) is extended through the outer casing (101), in such manner of the plurality of partitions (102) encloses the inner core (103). A plurality of hollow plates (104) mounted on the inner core (103) for spacing and upholding the inner core (103). In a preferred embodiment, the inner core (103) is transverse through the plurality of hollow plates (104).

A plurality of damping means (105) is wrapped over the inner core (103), arranged in a manner of the plurality of damping means (105) positioned between the plurality of partitions (102) and the plurality of hollow plates (104). In a preferred embodiment, the plurality of damping means (105) is fitted into a gap created between the plurality of partitions (102) and the plurality of hollow plates (104). In a preferred embodiment, the plurality of damping means (105) is a hyperelastic material which comprises rubber. Therefore, the plurality of hollow plates (104) are needed to transferred the force in perpendicular relative to the direction of inner core (103) and push the plurality of damping means (105) in axial direction to make it in volumetric compression condition to generate the restrain force.

A connecting means comprises a front connector (106) and end connector (107) is attached separately to each end of inner core (103) for installing the volumetric compression restrainer (100) to a structure joint.

Figure 5:
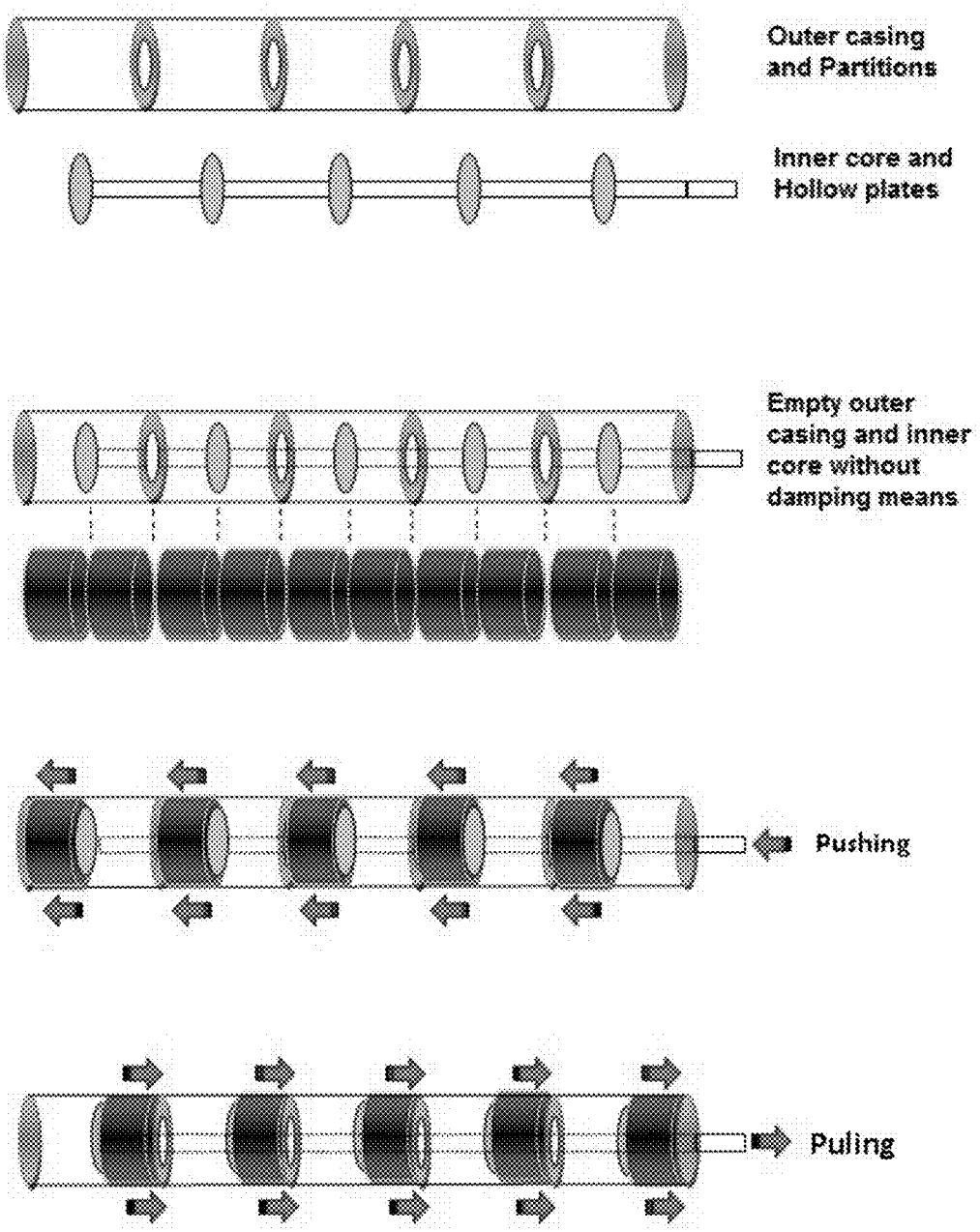
FIG. 5 shows pushing and pooling of the volumetric compression restrainer during vibration and movement.

FIG. 5 shows pushing and pulling of the volumetric compression restrainer (100) during vibration. Referring to FIG. 5, the plurality of partitions (102) and the plurality of hollow plates (104) are supporting the damping means (105) during pushing and pulling of the volumetric compression restrainer (100) and cause the displacement to be occurred. The plurality of partitions (102) acts as a supporter to support the incoming force from the pushing action when the plurality of damping means (105) is pushed against the plurality of the partitions (102). Whereas, the plurality of hollow plates acts as a supporter to support the incoming force from the pulling action when the plurality of damping means (105) is pulled towards the plurality of hollow plates (104). Therefore, a restrain force is generated in the volumetric compression restrainer (100).

Figure 6:
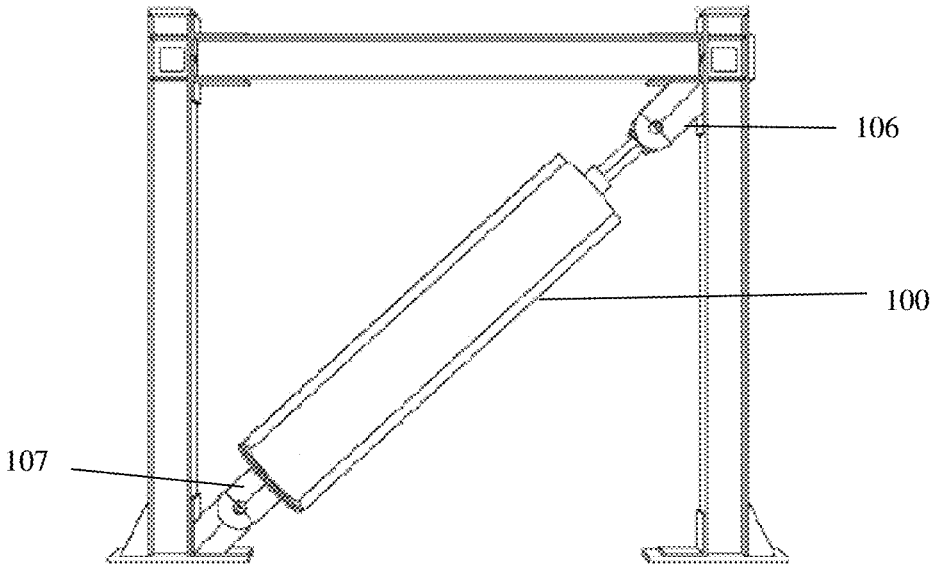
FIG. 6 shows volumetric compression retrainer installed to a structure building.

FIG. 6 shows a volumetric compression retrainer (100) is installed to a structure building connected by a front connector (106) and end connector (107).

Figure 7:
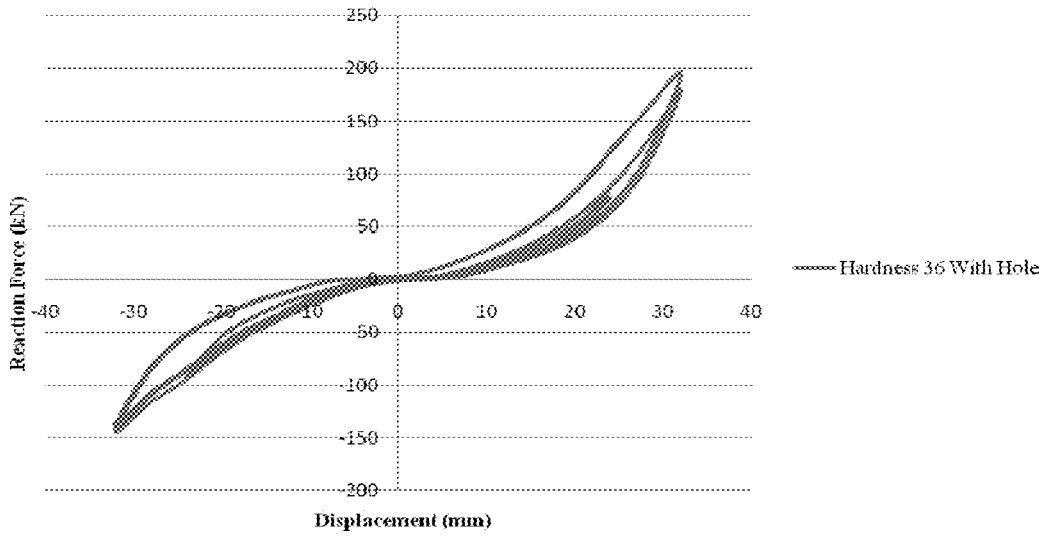
FIG. 7 shows a graph of reaction force with displacement with 36 hardness rubber with hole in the volumetric compression restrainer.
Figure 8:
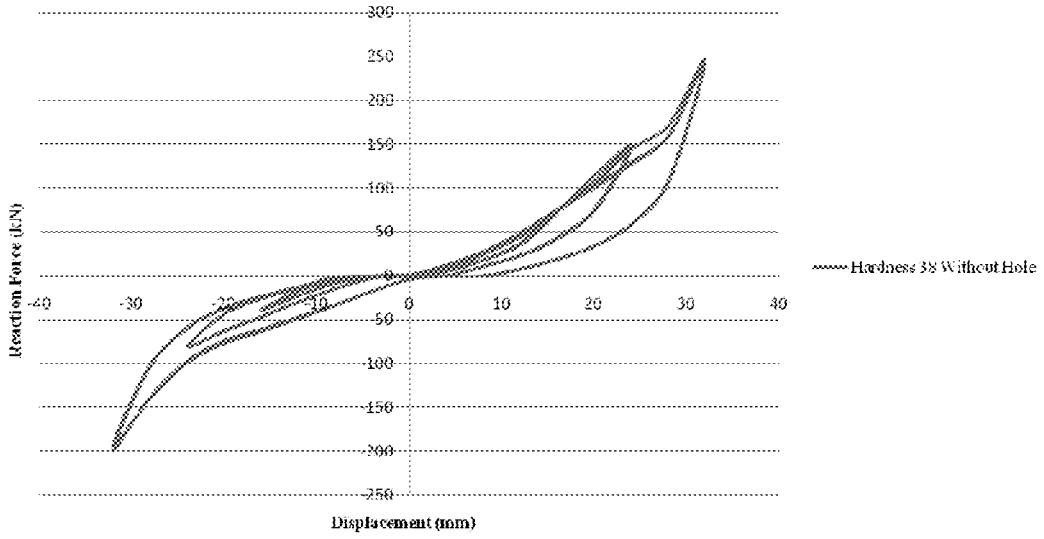
FIG. 8 shows a graph of reaction force with displacement with 38 hardness rubber without hole in the volumetric compression restrainer.

FIGS. 7 and 8 shows a graph of reaction force with displacement of a structure with 36 and 38 hardness rubbers with and without hole in the volumetric compression restrainer (100). The reaction force is more stable and lower displacement show in FIG. 7 in comparison with FIG. 8 due to the different hardness of rubbers and rubber with hole is used in FIG. 7. Said holes are in the section of the rubber to increase the deferability of rubber. Also, the hole of the rubber in experiment of FIG. 7 is enhancing the deformability of rubber damping means (105) with inner core (103) and outer casing (101) to act in higher displacement. Therefore, the restraining force is well generated in experiment of FIG. 7.

Figure 9:
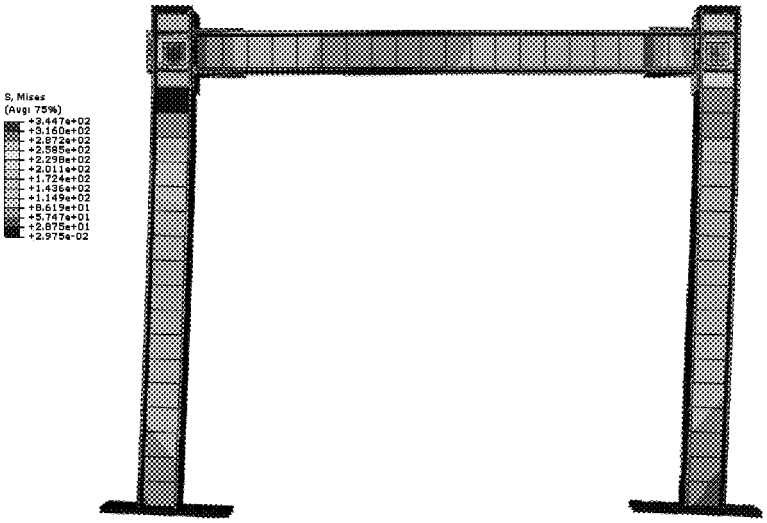
FIG. 9 shows a steel frame structure.
Figure 10:
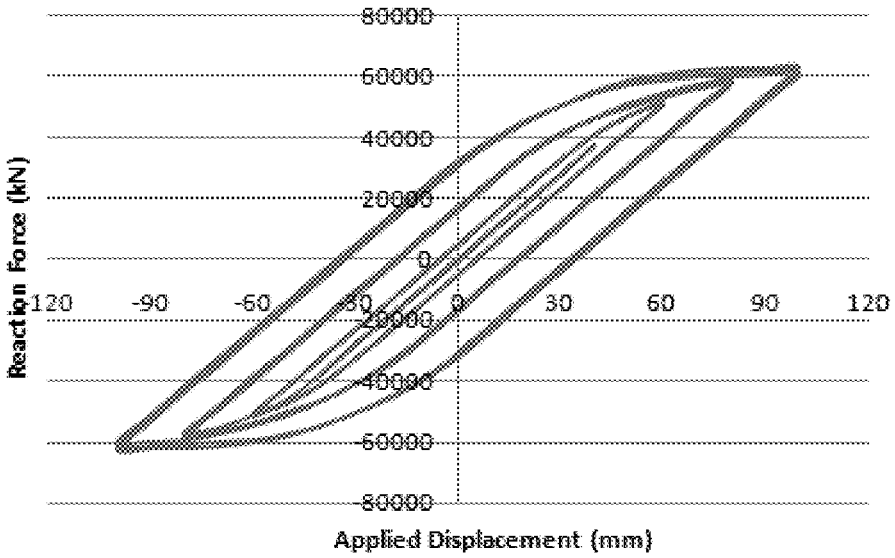
FIG. 10 shows a graph of reaction force with applied displacement for steel frame structure in FIG. 9.

FIG. 9 shows a steel frame structure and FIG. 10 shows a graph of reaction force with applied displacement for steel frame structure in FIG. 9. The steel frame as shown in FIG. 9 is without any bracing or restrainer and therefore unstable reaction force and displacement is shown in FIG. 10.

Figure 11:
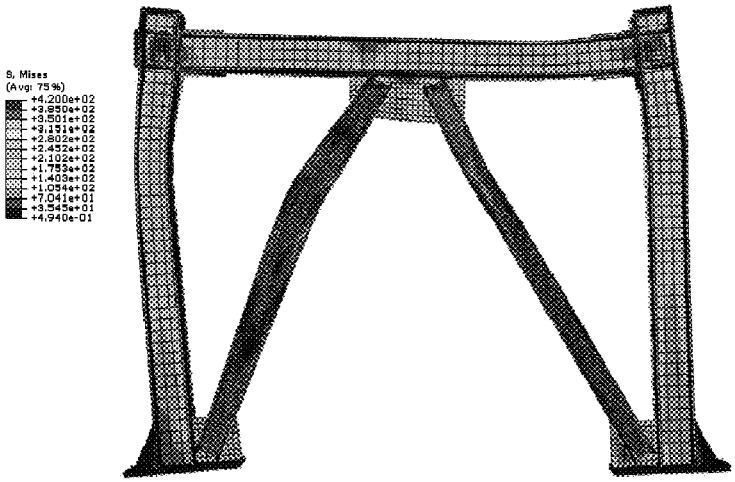
FIG. 11 shows a steel frame with chevron bracing structure subjected to lateral cyclic displacement.
Figure 12:
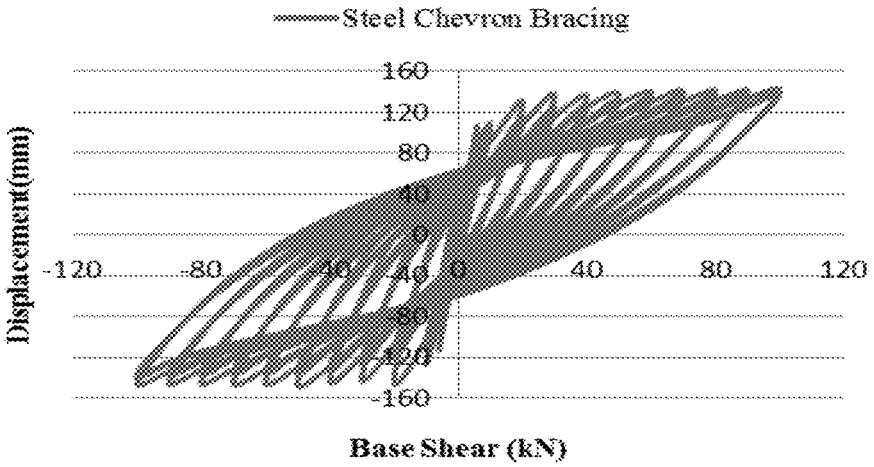
FIG. 12 shows a graph of displacement with base shear for steel frame with chevron bracing structure subjected to lateral cyclic displacement in FIG. 11.
Figure 13:
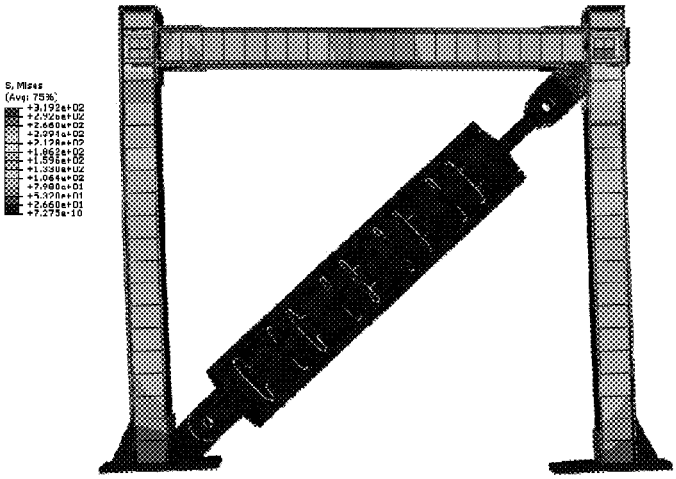
FIG. 13 shows a steel frame with volumetric compression restrainer subjected to lateral cyclic displacement.
Figure 14:
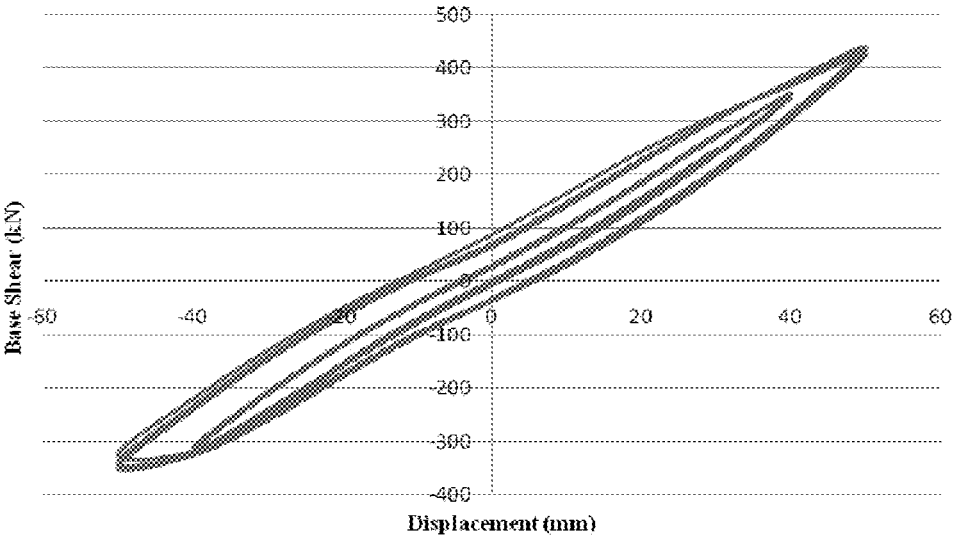
FIG. 14 shows a graph of base shear with displacement for steel frame with volumetric compression restrainer in FIG. 1 subjected to lateral cyclic displacement in FIG. 13.

FIG. 11 shows a steel frame with chevron bracing subjected to lateral cyclic displacement. The steel frame is slightly destroyed in FIG. 11 due to the steel frame is subjected to lateral cyclic displacement. FIG. 12 shows the result of displacement with base shear for steel frame in FIG. 11. According to the result in FIG. 12, excessive displacement is shown and unstable base shear shown. In contrast, a steel frame with volumetric compression restrainer (100) subjected to lateral cyclic displacement is shown in FIG. 13. The steel frame with volumetric compression restrainer (100) in FIG. 13 shows no destruction caused by lateral cyclic displacement. FIG. 14 shows the result of base shear with displacement for steel frame in FIG. 13. Referring to FIG. 14, the base shear and displacement are showing better performance during cyclic movement in comparison with the result for steel frame with chevron bracing.

Although the present invention has been described with reference to specific embodiments, also shown in the appended figures, it will be apparent for those skilled in the art that many variations and modifications can be done within the scope of the invention as described in the specification and defined in the following claims.

Description of the reference numerals used in the accompanying drawings according to the present invention:

| Reference Numerals | Description |
|---|---|
| 100 | Volumetric compression restrainer |
| 101 | Outer casing |
| 102 | A plurality of partitions |
| 103 | Inner core |
| 104 | A plurality of hollow plates |
| 105 | A plurality of damping means |
| 106 | Front connector |
| 107 | End connector |

We claim:

1. A volumetric compression restrainer (100) for preventing excessive displacement of a structure, comprising:

an outer casing (101) comprising a pair of C-shaped structures interconnected to one another to form a cylinder;

a plurality of annular half-circular plates (102) arranged in a parallel manner along a length of an inner surface of the pair of C-shaped structures with a spacing therebetween;

an inner core (103) extending through the outer casing (101), the plurality of annular half-circular plates (102) surrounding the inner core (103);

a plurality of circular hollow plates (104) mounted on the inner core (103);

a plurality of damping means (105) positioned over the inner core (103), the plurality of damping means (105) each formed of two half-circular tubular sections and positioned between the plurality of annular half-circular plates (102) and the plurality of circular hollow plates (104); and a front connector (106) engaged to one end of the inner core (103) and an end connector (107) engaged to the other end of the inner core (103), for installing the volumetric compression restrainer (100) to a structure joint.

2. The volumetric compression restrainer (100) according to claim 1, wherein the pair of C-shaped structures are interconnected to each other by bolts and nuts.

3. The volumetric compression restrainer (100) according to claim 1, wherein the plurality of damping means (105) is a hyperelastic material.

4. The volumetric compression restrainer (100) according to claim 3, wherein the hyperelastic material comprises rubber.

* * * * *